United States Patent [19]

Sugiura et al.

[11] Patent Number: 4,707,930

[45] Date of Patent: Nov. 24, 1987

[54] APPARATUS FOR MOUNTING A RELIEF PLATE FOR LETTERPRESS PRINTING

[75] Inventors: Masahiro Sugiura, Tokyo; Michiyuki Yoshida, Saitama, both of Japan

[73] Assignee: Sakata Shokai, Ltd., Osaka, Japan

[21] Appl. No.: 928,296

[22] Filed: Oct. 28, 1986

[51] Int. Cl.[4] ..... B41B 1/00

[52] U.S. Cl. ..... 33/623; 33/1 M

[58] Field of Search ..... 33/1 M, 503, 504, 505, 33/614, 619–621, 623, 615–618

[56] References Cited

U.S. PATENT DOCUMENTS 3,594,908 7/1971 Pagella ..... 33/503

4,133,111 1/1979 Logan ..... 33/1 M

*Primary Examiner*—Harry N. Haroian

*Attorney, Agent, or Firm*—Wenderoth, Lind & Ponack

[57] ABSTRACT

An apparatus for mounting a relief plate for letterpress printing on a carrier sheet includes a flat table for tautly fixing the carrier sheet, a holding stand extended across the flat table in the X-direction of a coordinate system, a first cursor connected to the holding stand for indicating a position in the Y-direction, and a second cursor connected to the holding stand for indicating a position in the X-direction. The apparatus further includes a first driving device for causing the holding stand to move in the Y-direction, a second driving device for causing the second cursor to move in the X-direction, a third driving device for causing the first and second cursors to move in a vertical direction, and a control unit which is computer-programmed to control the movements of the first and second cursors in the X-, Y- and vertical directions.

4 Claims, 10 Drawing Figures

APPARATUS FOR MOUNTING A RELIEF PLATE FOR LETTERPRESS PRINTING

BACKGROUND OF THE INVENTION

1. Field of the Invention

The present invention relates to an apparatus for mounting a relief plate for letterpress printing and, more particularly, to an apparatus for use in a method of letterpress printing wherein a relief plate is mounted on a carrier sheet which is then wound onto a plate cylinder for performing letterpress printing.

2. Description of the Prior Art

In preliminary operations for letterpress printing, particularly flexographic printing, a relief plate needs to be mounted on a plate cylinder with high precision, and this operation requires considerable skill and many years of experience. There have been increasing demands recently for achieving higher quality of printed matters in the art of flexographic printing, and the practice of performing multicolor printing with halftone images has expanded to evoke a need for achieving precise mounting of a relief plate onto a plate cylinder. Precision in mounting a relief plate is therefore essential for attaining printed matter of good quality. There are two methods of mounting a relief plate on a plate cylinder. One method involves directly mounting the relief plate on the plate cylinder with an adhesive, and the other involves mounting the relief plate on plastic films (hereinafter referred to as a carrier sheet) having superior dimensional stability such as a polyester film and then winding the carrier sheet onto a plate cylinder. The method of using a carrier sheet is widely utilized in the art of flexographic printing because the printing plate is easily replaced.

Two methods have heretofore been employed for mounting a relief plate on a carrier sheet: in one method, a ruling means such as a section paper is set on a table and, after a carrier sheet has been placed over the section paper, the relief plate is mounted on the carrier sheet, with marks being made on the basis of the calculation of the correct mounting positions and the estimated degree of elongation; in the other method, a mounter is used in accordance with the half-mirror method.

In the first method where the respective mounting positions are marked on the carrier sheet, an error may occur by an extent that corresponds to the thickness of the plate and considerable skill is required to achieve precise mounting. In addition, almost all of the steps of the mounting process must be carried out by a manual and hence inefficient method.

The second method requires no compensation for elongation or other factors since the respective positions for mounting a relief plate are determined with the carrier sheet being attached onto a cylinder. In this method, however, the operator performs all of his jobs looking at the image projected from the mirror and a particular mounting position will subtly vary depending upon the angle at which the image is seen. This introduces inevitable variations in reliability depending on operators. In addition, the plate cylinder that is called a dummy cylinder, used in this method is not what is set in the actual printing machine, but the dummy cylinder is employed which is equal in diameter to the latter. Therefore, if a plurality of printing machines are used, the shop is required to keep a corresponding number of dummy cylinders in stock and to replace one dummy cylinder with another which has the same diameter as that of the plate cylinder to be set in a particular machine.

SUMMARY OF THE INVENTION

In view of the above circumstances, it is a primary object of the present invention to provide an apparatus for mounting a relief plate on a carrier sheet without requiring use of a dummy cylinder or demanding great skill, and which yet achieves higher precision in the process of plate mounting.

To this end, the present invention provides an apparatus for mounting a relief plate for letterpress printing, which comprises: a flat table for tautly fixing a carrier sheet; a holding stand which extends across the flat table in the X-direction of a coordinate system and is movable in the Y-direction of the coordinate system; a first drive means for causing the holding stand to move in the Y-direction; a first cursor connected to the holding stand for indicating a position in the Y-direction; a second cursor connected to the holding stand for indicating a position in the X-direction; a second drive means for causing the second cursor to move in the X-direction; a third drive means for causing the first and second cursors to move in a vertical direction; and a control means which is computer-programmed to control the movements of the first and second cursors in the X-, Y- and vertical directions.

The above and other objects, features and advantages of the present invention will become more apparent from the following description of the preferred embodiment thereof, taken in conjunction with the accompanying drawings.

DESCRIPTION OF THE PREFERRED EMBODIMENT

One preferred embodiment of the relief plate mounting apparatus according to the present invention will be described hereinunder in detail with reference to the accompanying drawings.

Figure 1:
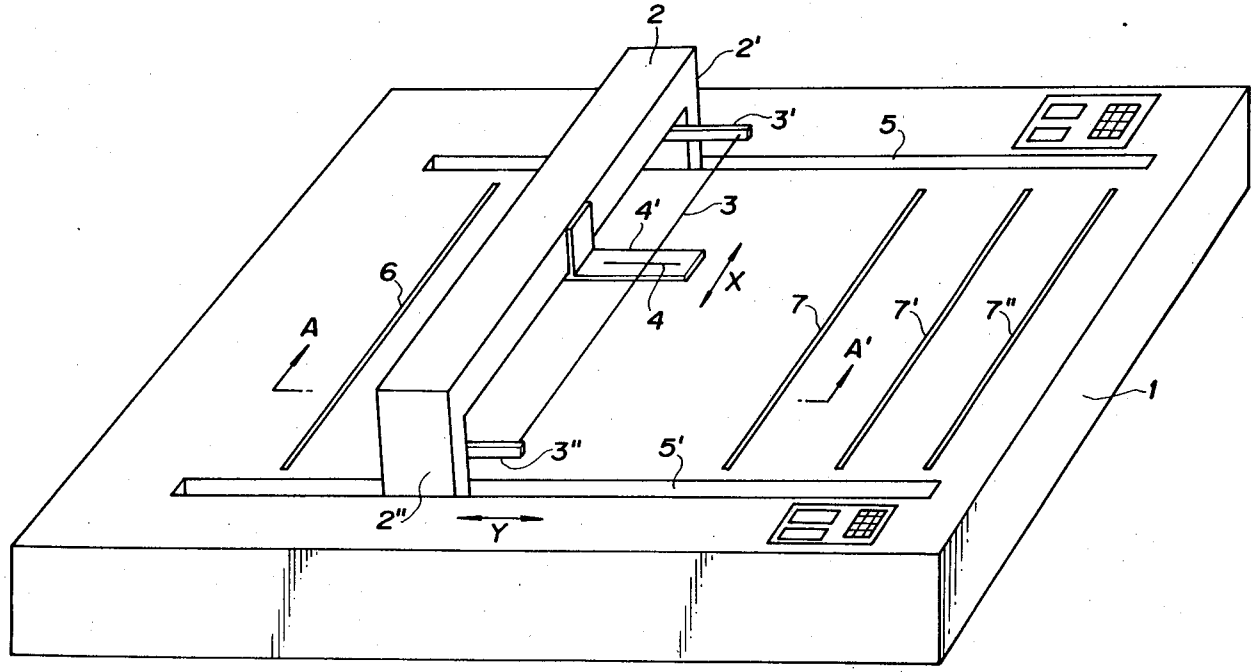
FIG. 1 is a perspective view showing the general arrangement of a relief plate mounting apparatus in accordance with one embodiment of the present invention.

FIG. 1 is a perspective view showing the general arrangement of a relief plate mounting apparatus in accordance with one embodiment of the present invention. In FIG. 1, the reference numeral 1 denotes a flat table on which a carrier sheet is stretched. A holding stand 2 is disposed in such a manner as to extend across the table 1 along one axis thereof, and provided with a Y-direction cursor 3 and an X-direction cursor 4 for indicating Y- and X-coordinate positions, respectively. The Y-direction cursor 3 is supported by supporting parts 3' and 3'' which are connected to the holding stand 2 so as to be retained thereby. The X-direction cursor 4 is supported by a frame member 4' which is movable in the X-direction and which is operatively connected to the holding stand 2 so as to be retained thereby. Openings 5 and 5' are provided in the surface of the table 1 for allowing the holding stand 2 to move along them. It should be noted that, if the support portions 2' and 2'' of the holding stand 2 are positioned on two side surfaces, respectively, of the table 1, the openings 5 and 5' are unnecessary.

Auxiliary means for stretching and tautly fixing a carrier sheet with high precision may be provided on the table 1 according to need.

Carrier sheets employed in letterpress printing, particularly flexographic printing, are generally made of plastic films having superior dimensional stability, such as polyester film. Fixing parts made of, for example, polyvinyl chloride are fixedly bonded to the upper and lower ends of the carrier sheet, the fixing parts respectively corresponding to grippers of a carrier sheet attaching means provided on a plate cylinder.

Figure 2:
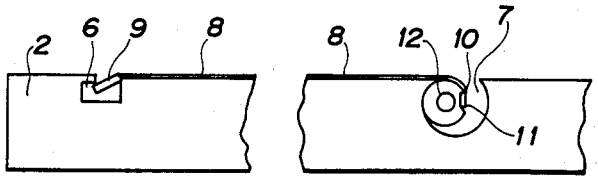
FIG. 2 is a fragmentary sectional view taken along the line A—A in FIG. 1.

Referring to FIG. 2, which is a fragmentary sectional view taken along the line A—A in FIG. 1, an arrangement is exemplarily shown in which auxiliary members for tautly fixing a carrier sheet on the surface of the table 1 are provided in the table 1, the carrier sheet having fixing parts such as those described above.

In FIG. 2, the reference numeral 6 denotes a slot having a retaining projection for retaining an upper fixing part 9 provided on the carrier sheet 8, and the numeral 7 represents a slot having a circular cross-section which is provided in the table 1 in such a manner as to receive and retain a lower fixing part 10 provided on the carrier sheet 8. It is necessary to provide slots 7 such as to correspond in number to the plate cylinders required for a particular printing system and having different diameters from each other, the slots 7 being disposed parallel with each other in a manner such as that shown by the reference numerals 7, 7' and 7'' in FIG. 1.

A shaft 12 is provided within the slot 7 in such a manner that the shaft 12 is rotatable while being inscribed in the inner surface of the slot 7 having a circular cross-section, the shaft 12 having a recess 11 provided in the outer periphery thereof so that the lower fixing part 10 is fitted in the recess 11. Thus, the carrier sheet, having the upper fixing part 9 retained by the retaining projection and the lower fixing part 10 retained by the recess 11, is wound up on the shaft 12, thereby enabling the carrier sheet to be stretched and tautly fixed over the surface of the table 1.

The position of the carrier sheet at which it is to be tautly fixed over the table is determined by aligning, for example, the left upper end portion of the carrier sheet with a register mark or the like. However, it is possible to effect positioning of the carrier sheet even more easily by, for example, adopting an arrangement in which register holes for alignment in the lateral and/or longitudinal direction are provided at necessary positions on the upper fixing part 9 of the carrier sheet, and register pins which correspond to the register holes are provided on the retaining projection.

In the case of employing a carrier sheet which has no fixing part connected to its lower end or which has no fixing parts connected to any portions thereof, it may be possible to secure such carrier sheet to the surface of the table 1 by aligning the carrier sheet with the X- and Y-coordinate positions on the table 1 by an appropriate method and securing the ends of the sheet by means of an adhesive tape or the like, or providing a multiplicity of minute holes in the surface of the table 1 and securing the sheet to the table surface by means of suction.

Figure 3:
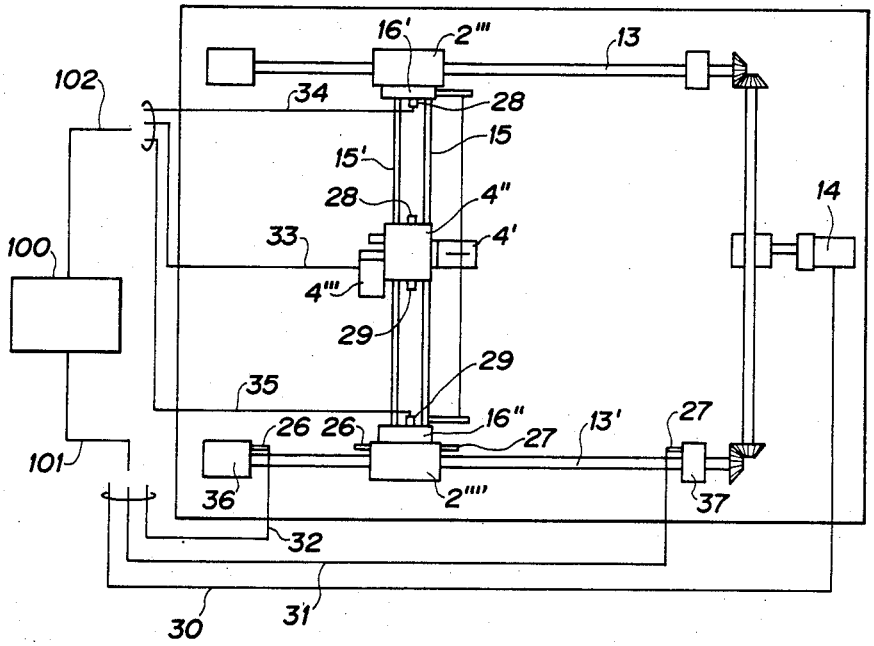
FIG. 3 is a sectional plan view showing a mechanism for moving a holding stand in a horizontal direction.

Mechanisms for moving the X- and Y-direction cursors 4 and 3 over the table 1 will be explained below with reference to FIGS. 3 to 5.

A mechanism for moving the holding stand 2 will first be explained with reference to FIG. 3 which is a sectional plan view thereof. In FIG. 3, the reference numerals 13 and 13' respectively denote guide shafts for guiding the movement of the holding stand 2. Slide blocks 2''' and 2'''' which are provided at the respective lower ends of the support portions 2' and 2'' of the holding stand 2 are slidably disposed on the guide shafts 13 and 13', respectively, so that the holding stand 2 is movable over the table 1 in the Y-direction through the slide blocks 2''' and 2'''' sliding on the respective shafts 13 and 13'. The holding stand 2 is moved by a Y-direction driving device 14 defined by, for example, a pulse motor, and the amount of movement, i.e., the Y-coordinate position of the holding stand 2, can be detected on the basis of the number of revolutions of the motor.

Figure 4:
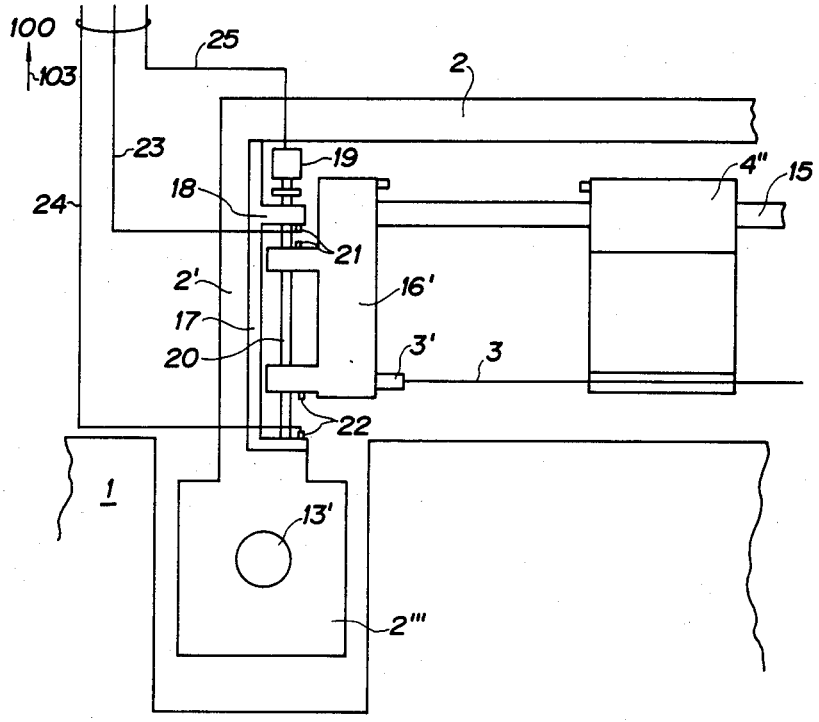
FIG. 4 is an enlarged fragmentary vertically sectional view showing the way in which X- and Y-direction cursors are individually connected to the holding stand.

FIG. 4 is an enlarged fragmentary sectional view showing the way in which the X- and Y-direction cursors 4 and 3 are connected to the holding stand 2.

In view of the fact that register marks for alignment of a relief plate are provided at the same height of the printing area of the relief plate (corresponding to the thickness of the plate), the relief plate mounting apparatus according to the present invention is arranged such that alignment of a relief plate is effected using the register marks. When alignment of a relief plate is effected on the basis of a mark on the carrier sheet according to a conventional method, an error may occur by an extent that corresponds to the thickness of the plate, and a particular mounting position may subtly vary depending upon the angle at which the relief plate is seen during a mounting operation according to the other conventional method, which means that it is impossible to mount a relief plate with high precision.

In the present invention, it is necessary to adjust the position of the cursors 3 and 4 in the vertical direction in accordance with the thickness of a particular relief plate or the relief plate with a backing layer bonded to the reverse surface of the plate according to need, and it consequently becomes necessary to provide a mechanism for adjustment of the position of the cursors 3 and 4 in the vertical direction.

Referring to FIG. 4, which shows one support portion provided at each end of the holding stand 2 (the other support portion being omitted), a stationary member 17 is secured to the inner side of the support portion 2', and a sliding part 16' which is slidable vertically is provided in opposing relation to the stationary member 17. The sliding part 16' is fixedly connected to another sliding member 16'' which is provided at the other end of the holding stand 2, by a guide shaft 15 for guiding the movement of the X-direction cursor 4 and another guide shaft 15' (see FIG. 5) which is provided according to need. In addition, the supporting parts 3' and 3'' for supporting the Y-direction cursor 3 are respectively secured to the sliding parts 16' and 16''.

The following is the reason why the Y-direction cursor 3 is connected between the supporting parts 3' and 3'' (the latter being omitted) respectively secured to the sliding parts 16' and 16'' (the latter being omitted), and disposed in such a manner as to extend across the table 1 in the X-coordinate direction and be movable in the Y-coordinate direction. Register marks for alignment are generally provided at three positions on a relief plate, and in such case two register marks are provided at the upper end portion of the plate. Therefore, in alignment of a particular mounting position of a relief plate, the two register marks need to be coincident with the same Y-coordinate position in order to eliminate any inclination with respect to the Y-direction, and thereafter, the relief plate is made coincident with a predetermined X-coordinate position, whereby it is possible to effect precise positioning of a relief plate. In view of the necessity to align simultaneously the two register marks with a predetermined Y-coordinate position, the Y-direction cursor 3 is provided such as to extend across the table 1 in the X-coordinate direction.

Figure 5:
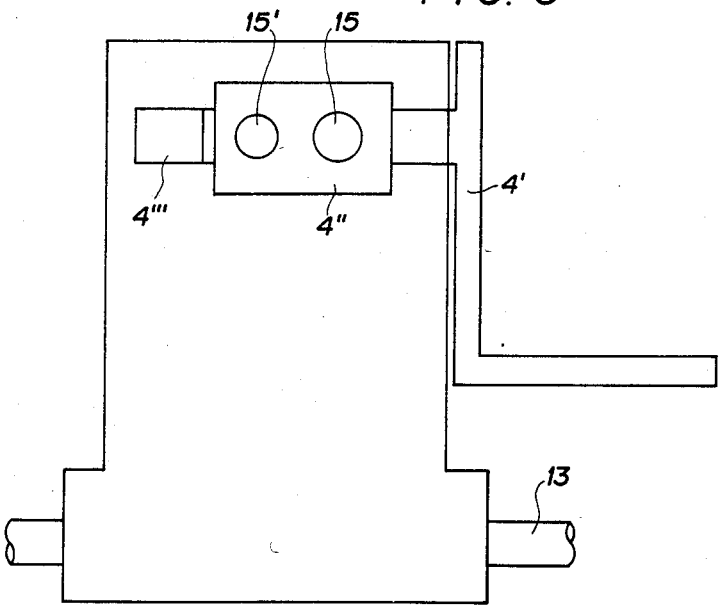
FIG. 5 is an enlarged fragmentary vertically sectional view showing a mechanism for horizontally moving a frame member which supports the X-direction cursor.

Referring to FIG. 5, a slide block 4'' is slidably fitted on the X-direction guide shafts 15 and 15', and the frame member 4' for supporting the X-direction cursor 4 is secured to the slide block 4''. The frame member 4' is shaped so as to define an X-direction cursor supporting position, and positioned in such a manner that X-direction cursor 4 intersects the Y-direction cursor 3 supported by the supporting parts 3' and 3''. In addition, an X-direction driving device 4''' is operatively connected to the slide block 4'', the driving device 4''' being defined by, for example, a pulse motor. Thus, as the driving device 4''' is activated, the frame member 4' is moved in the X-direction with the slide block 4'' which slides on the X-direction guide shafts 15 and 15'. In consequence, the X-direction cursor 4 is similarly moved in the X-direction.

The amount of movement in the X-direction, i.e., the position along the X-coordinate axis, can be detected on the basis of the number of revolutions of the pulse motor.

The following is a description of the connection between the stationary member 17 and the sliding part 16' which are provided on the inner side of the support portion 2' of the holding stand 2. The stationary member 17 has an upper stationary part 18 on which is mounted a vertically driving device 19 defined by, for example, a pulse motor, for vertically moving the sliding part 16'. The driving device 19 is in thread engagement with a vertical guide screw shaft 20 and adapted to vertically move the sliding part 16' which is guided by a vertical guide means (not shown), in cooperaton with a driving device which has the same arrangement as that of the device 19 and which is provided at the other end of the shaft 15. In response to the vertical movement of the sliding part 16', both the X- and Y-direction cursors 4 and 3 which are fixedly connected to the sliding part 16' are moved vertically, whereby these cursors can be moved to a position corresponding to the thickness of a particular relief plate which is to be mounted.

The following is a description of means for detecting the X-coordinate position of the X-direction cursor 4, the Y-coordinate position of the Y-direction cursor 3, and the height of these cursors.

Referring to FIG. 4, the stationary member 17 and the sliding part 16' are provided with position sensors 21 and 22 which are defined by, for example, limit switches. The position sensor 21 detects the fact that the sliding part 16' has reached the uppermost end position, and delivers a detection signal to a control unit 100 through a line 23, while the position sensor 22 detects the fact that the sliding part 16' has reached the lowermost end position, and delivers the detection signal to the control unit 100 through a line 24. A signal from the control unit 100 is transmitted to the vertically driving device 19 through a line 25. Thus, it is possible to detect the height of both the cursors 3 and 4 by, for example, assuming the lowermost end position to be the origin in terms of height.

Means for detecting the X- and Y-coordinate positions will be explained below with reference to FIG. 3.

Position sensors 26 and 27 which are defined by, for example, limit switches, are provided on two side surfaces of the slide block 2''', of the holding stand 2 which is slidably moved on the guide shaft 13' in the Y-direction and on the respective inner surfaces of securing member 36 and 37 for securing the guide shaft 13'. A signal representing the fact that the slide block 2''' has reached the left- or right-hand end (as viewed in FIG. 3) of the guide shaft 13' is delivered to the control unit 100 through a line 32 or 31. A signal from the control unit 100 is transmitted to the Y-direction driving device 14 through a line 30.

Thus, it is possible to detect the Y-coordinate position of the Y-direction cursor 3 by, for example, assuming the left-hand end of the guide shaft 13' to be the origin of the Y-coordinate axis.

Position sensors 28 and 29 similar to the position sensors 26 and 27 are respectively provided on two side surfaces of the slide block 4'' which is slidably fitted on the X-direction guide shaft 15 and the like, and on the respective inner surfaces of the sliding parts 16' and 16'', so as to detect the fact that the slide block 4'' has reached the upper or lower end (as viewed in FIG. 3) of the guide shaft 15. Detection signals are delivered to the control unit 100 through lines 34 and 35, and a signal from the control unit 100 is transmitted to the X-direction driving device 4'''. Thus, it is possible to detect the X-coordinate position of the X-direction cursor 4 by, for example, assuming the lower end of the guide shaft 15 to be the origin of the X-coordinate axis.

Figure 6:
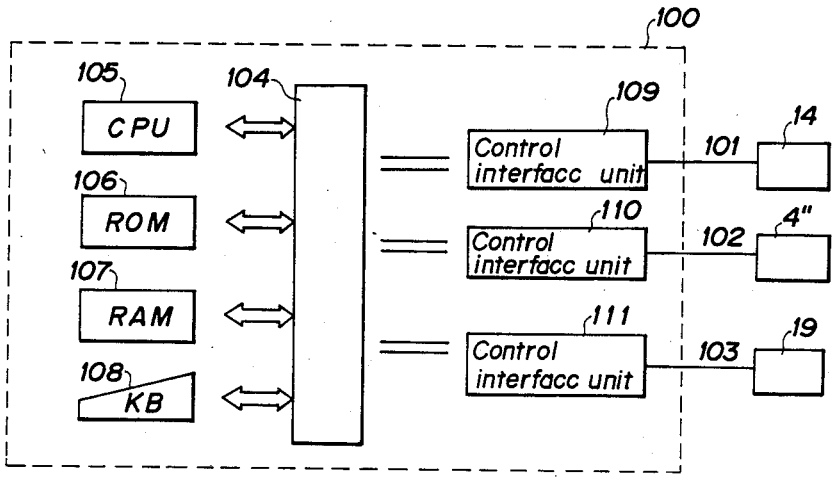
FIG. 6 is a block diagram showing one example of a hardware system which defines a control unit.

FIG. 6 is a block diagram showing one example of a hardware system which defined the control unit 100. Elements which constitute the system in combination are interconnected through a central bus 104.

A processor unit (CPU) 105 executes calculation concerning the movement of each cursor and control of the operation of the apparatus as a whole in accordance with various kinds of arithmetic and control program which are stored in a ROM 106. A RAM 107 stores, for example, information or data concerning kinds of carrier sheet, compressibility of carrier sheets in the Y-direction, kinds of printing operation (JOB), kinds of relief plate, coordinate positions for mounting relief plates, etc., and data resulting from the calculation carried out by the CPU 105.

An input unit 108 is defined by, for example, a keyboard, and is used to input various kinds of information or data which are to be stored in the RAM 107. In addition, an interface for connecting this hardware system to another computer system may be provided according to need. The reference numeral 109 denotes a control interface unit for the Y-direction driving device 14 which causes the holding stand 2 to move in the Y-direction; 110, a control interface unit for the X-direction driving device 4'''; and 111, a control interface unit for the vertically driving device 19.

Figure 7:
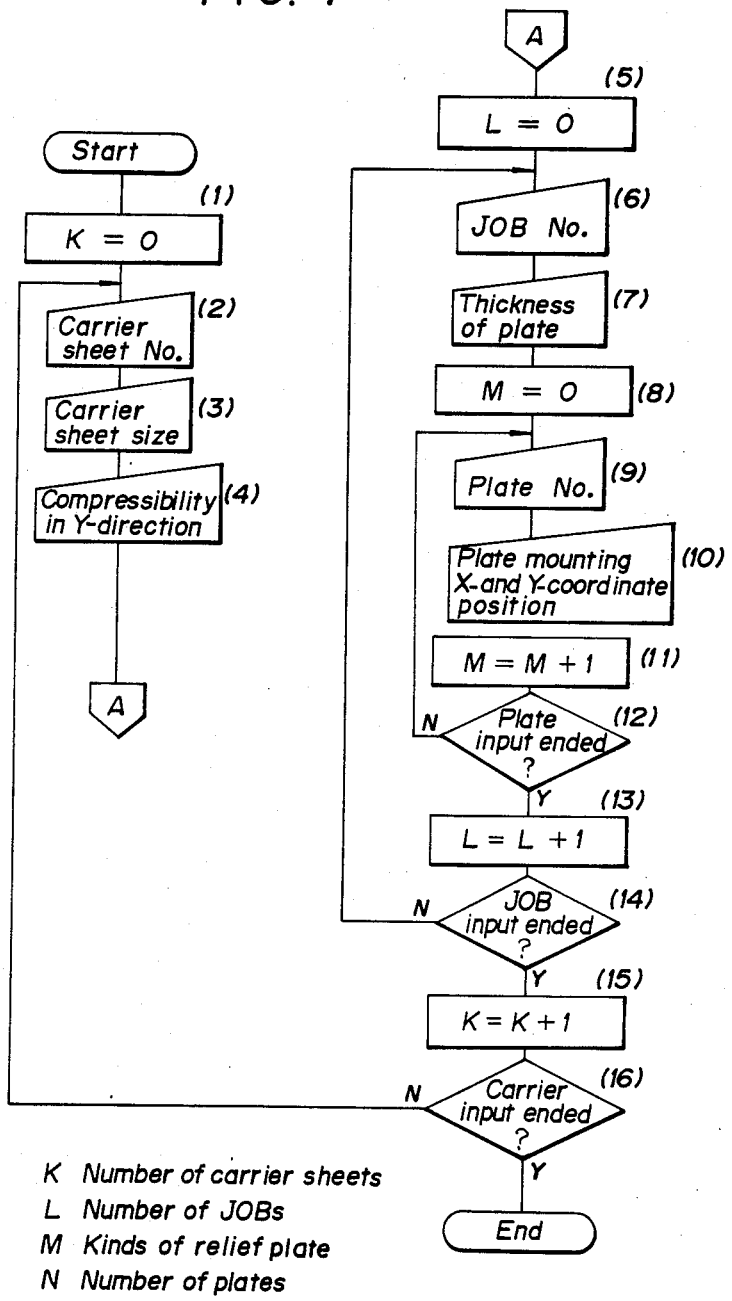
FIGS. 7 and 8 exemplarily show flow charts of control programs employed in the relief plate mounting apparatus according to the present invention.
Figure 8:
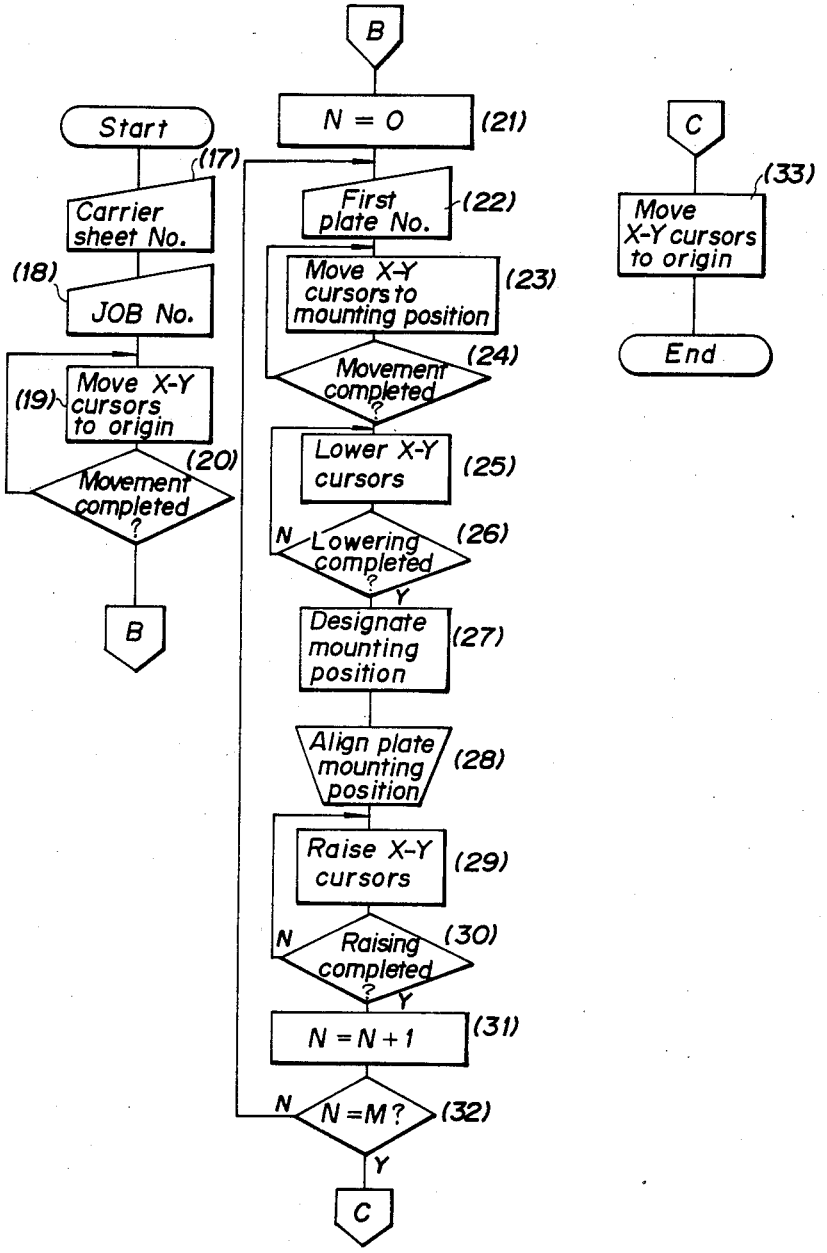

FIGS. 7 and 8 exemplarily show flow charts of control programs employed in the relief plate mounting apparatus according to the present invention.

The operation with the cursors shown in FIGS. 1 to 5 will be explained below with reference to these flow charts.

In the input processing (see FIG. 7), various kinds of information or data are input from the input unit 108 and loaded into the RAM 107 [Steps (1) to (16)], the information or data including: the kind of letterpress printing machine employed; the kind (represented by K) of carrier sheet selected in accordance with the diameter of the plate cylinder employed; the size of the employed carrier sheet; compressibility of the carrier sheet in the Y-direction; a JOB number (represented by L) as operation information needed to carry out an actual letterpress printing, such as a printing operation number, the printing sequence (related to colors of the inks employed) for printing units in the case of multicolor printing, etc.; the thickness of each relief plate employed; the kind of relief plates (represented by M); and the coordinates representing the position for mounting each relief plate.

To start an actual relief plate mounting operation, a carrier sheet which is to be used is selected, and the upper fixing part 9 of the carrier sheet is inserted into the slot 6 in the table 1 and retained by the retaining projection. The lower fixing part 10 is inserted into the recess 11 in the shaft 12 disposed within the slot 7, and the shaft 12 is rotated to wind up the end portion of the carrier sheet thereon, thereby tautly fixing the sheet over the table 1. The carrier sheet is positioned in such a manner that the left upper end of the sheet is coincident with the mutual origin of the X- and Y-coordinate axes. It is assumed that, when the slide blocks 2'''' and 4'' are respectively positioned at the left end of the Y-direction guide shaft 13' and the lower end of the X-direction guide shaft 15 (see FIG. 3), the positions of the Y- and X-direction cursors 3 and 4 respectively indicate the origins of the Y- and X-coordinate axes. In this way, it is possible to use the same origin irrespective of the size of each individual carrier sheet.

Upon the completion of the setting of the carrier sheet, a relief plate mounting operation is started.

When the No. of the carrier sheet and a JOB No. are input through the keyboard 108, a check is made as to whether or not the X- and Y-direction cursors 4 and 3 are at the respective origins of the X- and Y-coordinate axes. If any of the cursors 3 and 4 is at any other position, this cursor is moved to the origin concerned, and the next instruction is awaited [Steps (17) to (20)].

Then, the No. of a relief plate to be mounted is designated. In consequence, the X- and Y-direction driving devices 4''' and 14, i.e., the pulse motors, are respectively rotated by amounts corresponding to the coordinates that represent a predetermined relief plate mounting position, thereby moving the respective cursors to said position [Steps (21) to (24)]. As to the movement of the Y-direction cursor 3, a correction is made in accordance with the compressibility corresponding to the diameter of the plate cylinder employed.

When the movement of the cursors 3 and 4 has been completed, the vertically driving device 19 is activated to lower the slide block 16' by a necessary amount so that the cursors 3 and 4 are disposed at a position corresponding to the thickness of the relief plate, and a desired relief plate mounting position is designated [Steps (25) to (27)].

Figure 9A:
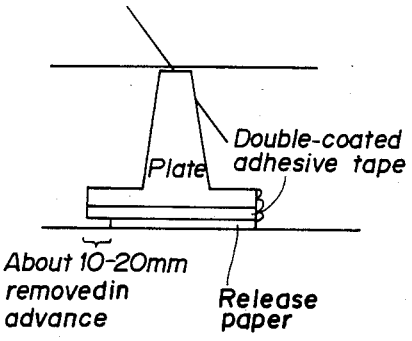
FIGS. 9A and 9B exemplarily show a relief plate mounting operation.
Figure 9B:
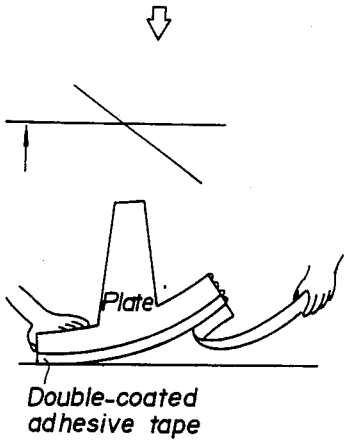

Mounting of a relief plate is effected in the manner exemplarily shown in FIGS. 9A and 9B. More specifically, a strip of double-coated adhesive tape or other similar means is stuck to the reverse side of a relief plate in advance. Portions of released paper which respectively correspond to the positions of register marks are removed, and the plate is positioned by aligning the register marks with the Y- and X-direction cursors 3 and 4, and temporarily fixed [Step (28)]. The alignment between the register marks on the relief plate and the Y- and X-direction cursors 3 and 4 is effected with high precision since the Y-direction cursor 3 of the relief plate mounting apparatus according to the present invention is provided in such a manner as to extend across the table 1 in the X-coordinate direction. More specifically, among the two register marks provided on the upper part of the relief plate, for example, the left-hand register mark is made coincident with the intersection between the Y- and X-direction cursors 3 and 4 in such a manner that the upper surface of the plate is in contact or substantially in contact with the cursors 3 and 4, and the right-hand register mark is made coincident with the Y-direction cursor 3 in a state similar to the above, whereby it is possible to effect a precise carrier sheet positioning operation without any problem such as torsion deflection arising.

When temporary mounting of the relief plate has been completed, the cursors 3 and 4 are moved upward, and the next instruction for designating a desired coordinate position for mounting a subsequent relief plate is awaited [Steps (29) to (30)].

After the cursors 3 and 4 have been raised, the released paper remaining on the reverse surface of the positioned relief plate is removed, and the plate is rigidly secured to the carrier sheet. When the No. of the subsequent relief plate is input, an operation similar to the above is executed. More specifically, the cursors 3 and 4 are moved to designate a desired coordinate position, and a necessary number (e.g., M) of relief plates are mounted. The cursors 3 and 4 are then returned to the starting point to end the operation [Steps (31) to (32)].

As has been described above, it is possible with the relief plate mounting apparatus according to the present invention to handle a carrier sheet and a relief plate on a flat table and enable a relief plate to be positioned with considerably high precision since alignment is carried out using register marks provided on the relief plate rather than using marks on a carrier sheet or a half-mirror method as in the prior art.

As to the compressibility of carrier sheets in the Y-direction which depends on the diameter of each individual plate cylinder, a compressibility is set for each kind of carrier sheet in advance to enable correction of designation of a particular Y-direction coordinate position on the basis of the compressibility set for each carrier sheet. It is therefore possible to precisely designate a desired position on any carrier sheet corresponding to any cylinder diameter, and it is unnecessary to carry out a troublesome manual operation or prepare a multiplicity of dummy cylinders.

What is claimed is:

1. An apparatus for mounting a relief plate for letterpress printing, which comprises:

a flat table for tautly fixing a carrier sheet;

a holding stand which extends across said flat table in the X-direction of a coordinate system and is movable in the Y-direction of the coordinate system;

a first drive means for causing said holding stand to move in the Y-direction;

a first cursor connected to said holding stand for indicating a position in the Y-direction;

a second cursor connected to said holding stand for indicating a position in the X-direction;

a second drive means for causing said second cursor to move in the X-direction;

a third drive means for causing the first and second cursors to move in a vertical direction; and control means which are computer-programmed to control the movements of said first and second cursors in the X-, Y- and vertical directions.

2. An apparatus according to claim 1, wherein said first cursor is provided in such a manner as to extend across said table in the X-direction.

3. An apparatus according to claim 2, wherein the intersection between said first and second cursors is made coincident with one of the two register marks provided on the upper part of the relief plate in such a manner that said intersection is substantially in contact with said register mark and at the same time, the other register mark is made coincident with said first cursor in such a manner that the second register mark is substantially in contact with said first cursor.

4. An apparatus according to claim 1, wherein said flat table is provided with auxiliary members for tautly fixing the carrier sheet over said table, said auxiliary members including a slot having a retaining projection for retaining an upper fixing part provided on the carrier sheet, and a slot accommodating a shaft having a recess for receiving a lower fixing part provided on said carrier sheet so as to wind up said sheet on said shaft.

* * * * *